US008006755B2

(12) United States Patent
Bicerano

(10) Patent No.: US 8,006,755 B2
(45) **Date of Patent: *Aug. 30, 2011**

(54) PROPPANTS COATED BY PIEZOELECTRIC OR MAGNETOSTRICTIVE MATERIALS, OR BY MIXTURES OR COMBINATIONS THEREOF, TO ENABLE THEIR TRACKING IN A DOWNHOLE ENVIRONMENT

(75) Inventor: Jozef Bicerano, Midland, MI (US)

(73) Assignee: Sun Drilling Products Corporation, Belle Chasse, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/369,455

(22) Filed: Feb. 11, 2009

(65) Prior Publication Data

US 2010/0038083 A1 Feb. 18, 2010

Related U.S. Application Data

(60) Provisional application No. 61/089,179, filed on Aug. 15, 2008.

(51) Int. Cl.
*E21B 47/00* (2006.01)
*E21B 43/267* (2006.01)

(52) U.S. Cl. ..... 166/250.12; 166/250.1; 166/280.2; 428/407

(58) Field of Classification Search ..... None
See application file for complete search history.

(56) References Cited

U.S. PATENT DOCUMENTS

| | | | |
|---|---|---|---|
| 3,843,566 | A | 10/1974 | Barrett |
| 4,427,793 | A | 1/1984 | Reed et al. |
| 5,597,784 | A | 1/1997 | Sinclair et al. |
| 6,116,342 | A | 9/2000 | Clark |
| 6,248,838 | B1 | 6/2001 | Albright |
| 6,330,916 | B1 | 12/2001 | Rickards et al. |
| 6,451,953 | B1 | 9/2002 | Albright |
| 6,499,536 | B1 | 12/2002 | Ellingsen |
| 6,607,036 | B2 | 8/2003 | Ranson et al. |
| 6,632,527 | B1 | 10/2003 | McDaniel et al. |
| 6,737,386 | B1 | 5/2004 | Moorhouse et al. |
| 6,759,463 | B2 | 7/2004 | Lorah et al. |
| 7,032,664 | B2 | 4/2006 | Lord et al. |
| 7,073,581 | B2 | 7/2006 | Nguyen |
| 7,082,993 | B2 | 8/2006 | Ayoub et al. |
| 7,189,767 | B2 | 3/2007 | Gore et al. |
| 7,210,526 | B2 | 5/2007 | Knobloch |
| 7,632,688 | B2 | 12/2009 | Oka et al. |
| 7,803,740 | B2 | 9/2010 | Bicerano et al. |
| 7,803,741 | B2 | 9/2010 | Bicerano et al. |
| 7,803,742 | B2 | 9/2010 | Bicerano et al. |
| 7,819,181 | B2 | 10/2010 | Entov et al. |
| 2007/0021309 | A1 | 1/2007 | Bicerano |
| 2007/0066491 | A1 | 3/2007 | Bicerano |
| 2007/0131424 | A1 | 6/2007 | Fripp |
| 2007/0154268 | A1 | 7/2007 | Barron |
| 2007/0161515 | A1 | 7/2007 | Bicerano |
| 2007/0181302 | A1 | 8/2007 | Bicerano |
| 2007/0259183 | A1 | 11/2007 | Knobloch |
| 2007/0287636 | A1 | 12/2007 | Bicerano |
| 2007/0298978 | A1 | 12/2007 | Crews |
| 2008/0062036 | A1 | 3/2008 | Funk |
| 2008/0139419 | A1 | 6/2008 | Huang |
| 2008/0149345 | A1 | 6/2008 | Marya |
| 2008/0149881 | A1 | 6/2008 | Park |
| 2009/0029878 | A1 | 1/2009 | Bicerano |

FOREIGN PATENT DOCUMENTS

| | | | |
|---|---|---|---|
| EP | 06773059 | | 9/2009 |
| WO | 9927229 | | 6/1999 |
| WO | 2004087798 | A1 | 10/2004 |
| WO | 2004092732 | A1 | 10/2004 |
| WO | 2006072069 | | 7/2006 |
| WO | 2006135892 | | 12/2006 |
| WO | 2007146067 | | 12/2007 |
| WO | 2008124080 | | 10/2008 |
| WO | 2009005880 | | 1/2009 |
| WO | 2009124029 | | 10/2009 |
| WO | PCT/US2009/52825 | | 10/2009 |
| WO | 2010019424 | A1 | 2/2010 |

*Primary Examiner* — Zakiya W. Bates

(74) *Attorney, Agent, or Firm* — Morgan, Lewis & Bockius, LLP

(57) ABSTRACT

A method for "tagging" proppants so that they can be tracked and monitored in a downhole environment, based on the use of composite proppant compositions comprising a particulate substrate coated by a material whose electromagnetic properties change at a detectable level under a mechanical stress such as the closure stress of a fracture. In another aspect, the invention relates to composite proppant compositions comprising coatings whose electromagnetic properties change under a mechanical stress such as the closure stress of a fracture. The substantially spherical composite proppants may comprise a thermoset nanocomposite particulate substrate where the matrix material comprises a terpolymer of styrene, ethylvinylbenzene and divinylbenzene, and carbon black particles possessing a length that is less than 0.5 microns in at least one principal axis direction incorporated as a nanofiller; upon which particulate substrate is placed a coating comprising a PZT alloy manifesting a strong piezoelectric effect or Terfenol-D manifesting giant magnetostrictive behavior to provide the ability to track in a downhole environment.

32 Claims, No Drawings

PROPPANTS COATED BY PIEZOELECTRIC OR MAGNETOSTRICTIVE MATERIALS, OR BY MIXTURES OR COMBINATIONS THEREOF, TO ENABLE THEIR TRACKING IN A DOWNHOLE ENVIRONMENT

This application claims the benefit of U.S. Provisional Application No. 61/089,179 filed Aug. 15, 2008.

FIELD OF THE INVENTION

The present invention relates to a new method for "tagging" proppants so that they can be tracked and monitored in a downhole environment. This method is based on the use of new composite proppant compositions that comprise coatings by materials whose electromagnetic properties change under a mechanical stress such as the closure stress of a fracture. These changes of electromagnetic properties are detected to track and monitor the locations of the proppants.

BACKGROUND

Proppants are solids such as sand, ceramic, polymer, or composite particles, that are often used during fracture stimulation to keep a fracture open by resisting the closure stress applied by the geological formation above the fracture.

In many situations, a substantial portion of the proppant does not remain in a fracture where it has been placed but instead flows back to the wellbore, so that it is valuable to be able to assess the extent of any flowback. Furthermore, a knowledge of the locations of the proppant particles can also provide valuable information about the fracture geometry. The ability to monitor the locations of the proppant particles over time after their placement in a downhole environment is, therefore, a highly desirable objective. Progress towards the attainment of this objective has hitherto been both difficult to make and limited in its scope.

U.S. patent application Ser. No. 12/206,867 teaches a method for "tagging" proppants based on the use of new composite proppant compositions containing dispersed fillers whose electromagnetic properties change under a mechanical stress such as the closure stress of a fracture, and is incorporated in its entirety herein by reference.

Several additional publications will be cited and discussed briefly in the paragraphs that follow. We emphasize that we do not consider any of these publications to constitute prior art for our invention, and that they are being cited and discussed as general background information.

The patent application publication to Huang (U.S. 20080139419), assigned to Baker Hughes Incorporated, provides for "Viscosity Enhancers for Viscoelastic Surfactant Stimulaton Fluids". Discussed is the addition of pyroelectric crystal and/or piezoelectric crystal particles to an aqueous viscoelastic surfactant (VES) fluid to demonstrate improved, enhanced or increased viscosity of the VES fluid. The viscosity enhancers herein are believed to be particularly useful in VES-gelled fluids used for well completion or stimulation and other uses and applications where the viscosity of VES-gelled aqueous fluids may be increased. The VES-gelled fluids may further comprise proppants or gravel, if they are intended for use as fracturing fluids or gravel packing fluids, respectively; although such uses do not require that the fluids include proppants or gravel.

The patent application publication to Marya et al. (U.S. 20080149345), assigned to Schlumberger Technology Corporation, provides for "Smart Actuation Materials Triggered by Degradation in Oilfield Environments and Methods of Use". Disclosed is a material placed in a downhole drilling environment that is responsive electrically or magnetically to said environment. This material can be a proppant.

The patent application publication to Fripp (U.S. 20070131424), assigned to Halliburton Energy Services, provides for "Proppant for Use in a Subterranean Formation". Disclosed is a proppant composition that can include a layer of material able to respond to pressures within the drilling environment. The disclosure states that this can be either an electrically responsive or a magnetically responsive substance.

The patent application publication to Funk et al. (U.S. 20080062036), assigned to Hexion Specialty Chemicals, provides for "Logging Device with Down-Hole Transceiver for Operation in Extreme Temperatures". Disclosed is a method for measuring the geometry of a propped fracture in a subterranean environment. Proppants having electrical conductivity are discussed wherein said proppants consist of coated thermoset polymer particles. The coating can have piezoelectric properties. The disclosure does not appear to mention mechanical stress as being useful for any embodiment of the invention that it teaches.

The patent application publication to Rediger et al. (U.S. 20080283243), assigned to Georgia-Pacific Chemicals, provides approaches for "Reducing Flow-back in Well Treating Materials". It teaches the placement of magnetic coatings on proppant particles to stabilize a proppant pack and thus reduce particulate flowback and fines transport. The magnetic particles are applied in a powdered form. They may be adhered to a proppant substrate by using various methods. Preferred methods include the use of (a) a hot melt (thermoplastic) adhesive (possibly comprising a thermoplastic resin and/or a wax powder), and (b) a phenol-formaldehyde novolac resin crosslinked with a hexamine (resulting in a thermoset adhesive after crosslinking).

The patent publication to Ellingsen (U.S. Pat. No. 6,499,536), assigned to Eureka Oil ASA, provides for a "Method to Increase the Oil Production from an Oil Reservoir". A magnetic or magnetostrictive material is injected through an oil well into the oil reservoir and then the material is vibrated with the aid of an alternating electric field. Oil is then drawn from the same reservoir from the same well in which the magnetic or magnetostrictive material was injected. The vibrations created in the injected material can be changed by changing the frequency of the applied electric current passed into the reservoir.

The following two books provide general background information on piezoelectric and/or magnetostrictive materials: APC International, Ltd., "Piezoelectric Ceramics: Principles and Applications" (2002); and G. Engdahl (editor), "Handbook of Giant Magnetostrictive Materials," Academic Press, New York (2000).

SUMMARY OF THE INVENTION

The present invention relates to a method for "tagging" proppants so that they can be tracked and monitored in a downhole environment. This new method is based on the use of new composite proppant compositions comprising from approximately 0.001% to approximately 75% by volume of a coating whose electromagnetic properties change under a mechanical stress such as the closure stress of a fracture. These changes of electromagnetic properties are detected by means of any suitable technique, to track and monitor the locations of the proppants. Suitable techniques include, but are not limited to, microseismic monitoring technology.

While the particle compositions of the invention were developed with proppant tracking applications specifically in mind, such particles can also be used beneficially in many other applications by tailoring specific embodiments of the invention to meet the targeted performance requirements of other applications.

Any suitable material (such as, but not limited to, a sand, a ceramic, or a polymer) may be used as a particulate substrate in some embodiments of the composite proppant compositions of the invention. In some other embodiments, some of the ingredients of a composite proppant of the invention can be agglomerated and held together by means of a binder material to form a particulate substrate.

In some embodiments, the composite proppant compositions may include materials manifesting the piezoelectric effect or the magnetostrictive effect, which may be placed on these particulate substrates as a coating to serve as "tags" and thus enable the tracking of the proppant locations in a downhole environment. Such a coating whose electromagnetic properties change under a mechanical stress may consist of a single layer in some embodiments, while multilayer coatings comprising any suitable number of layers (such as, but not limited to, 2 layers, 3 layers, 4 layers, or any larger number of layers) may be used in other embodiments.

In some other embodiments, the composite proppant may include materials whose electromagnetic properties change under a mechanical stress, such as materials manifesting the piezoelectric effect or the magnetostrictive effect, mixed in with the particulate substrate. For example, in addition to being present as a coating on a particulate substrate, such a material may also penetrate into the particulate substrate so that there is a penetration depth throughout which it can be found inside the particulate substrate. The material may decrease in concentration towards the interior of the particulate substrate.

In some other embodiments, the composite proppant may include mixtures of particulate substrates that are coated on the outside with such a material and particulate substrates where such a material is also mixed with the particulate.

Many methods are known for the placement of a coating on a particulate substrate. Any available method for the placement of a coating on a particulate substrate may be used to place the coatings on a particulate substrate to prepare embodiments of the invention. Such methods include, but are not limited to, adhesion of powders of a coating material to the substrate by using a thermosetting adhesive, adhesion of powders of a coating material to the substrate by using a thermoplastic adhesive, a sol-gel process, electrophoretic deposition, fluidized bed coating, spray-coating, or combinations thereof.

The proppants of the invention may also contain any other desired ingredients; including, but not limited to, rigid (mechanically reinforcing) fillers, impact modifiers, protective coatings (distinct from and hence in addition to a coating manifesting electromagnetic properties that change under a mechanical stress), or mixtures or combinations thereof.

The imposition of a mechanical stress results in the generation of an electric field by a piezoelectric material and in the generation of a magnetic field by a magnetostrictive material. A change in the magnitude and/or direction of an imposed mechanical stress results in a change in the electric field generated by a piezoelectric material and a change in the magnetic field generated by a magnetostrictive material. The factors governing the ability of a material to manifest piezoelectric or magnetostrictive behavior are well-established. Many materials are known to manifest such behaviors to varying magnitudes. Any of these materials may be used as a piezoelectric or magnetostrictive coating in the proppants of the invention.

Strongly piezoelectric and/or giant magnetostrictive materials are often significantly more expensive than the types of materials from which commercial proppants are generally manufactured. There is, therefore, often a significant economic advantage to the use of blends of proppants, where the blend includes a quantity of "tagged" proppants that is sufficient to produce a signal of detectable magnitude mixed with less expensive "untagged" proppants. The use of "tagged" proppants in such proppant blends, at amounts of at least 1% by weight of the blend, is also an aspect of the present invention.

DETAILED DESCRIPTION

Details will now be provided on various embodiments of the invention. These details will be provided without reducing the generality of the invention. Many additional embodiments fall within the full scope of the invention as taught in the SUMMARY OF THE INVENTION section.

In one embodiment of the invention, a piezoelectric coating, a magnetostrictive coating, or mixtures or combinations thereof, are placed on a thermoset polymer particulate substrate. In one such embodiment, the thermoset polymer particles that are used as particulate substrates are prepared via suspension polymerization. They are substantially spherical in shape; where a substantially spherical particle is defined as a particle having a roundness of at least 0.7 and a sphericity of at least 0.7, as measured by the use of a Krumbien/Sloss chart using the experimental procedure recommended in International Standard ISO 13503-2, "Petroleum and natural gas industries—Completion fluids and materials—Part 2: Measurement of properties of proppants used in hydraulic fracturing and gravel-packing operations" (first edition, 2006), Section 7, for the purposes of this disclosure. The composite proppant particles of one embodiment of the invention, which are produced by placing a piezoelectric coating, a magnetostrictive coating, or mixtures or combinations thereof, on such a particulate substrate, are also substantially spherical in shape.

In one embodiment, the thermoset polymer particulate substrate includes a terpolymer of styrene (St), ethylvinylbenzene (EVB), and divinylbenzene (DVB) (U.S. Application No. 20070021309). The extent of crosslinking in these embodiments can be adjusted by varying the percentage of the crosslinker (DVB) in the reactive precursor mixture and/or by postcuring via heat treatment after polymerization. In one such embodiment, the thermoset polymer particulate substrate may also contain a dispersed nanofiller, where, by definition, a nanofiller possesses at least one principal axis dimension whose length is less than 0.5 microns (500 nanometers). In one embodiment, the dispersed nanofiller may be carbon black, as taught in U.S. Application No. 20070066491. In another embodiment, the thermoset polymer particulate substrate may also contain an impact modifier, as taught in U.S. Application No. 20070161515. In some embodiments, one or more of the St, EVB and DVB monomers used in the reactive precursor mixture may be replaced by reactive ingredients obtained and/or derived from renewable resources such as vegetable oils and/or animal fats (U.S. Application No. 20070181302). A polymer precursor mixture used in manufacturing said thermoset polymer particulate substrate may further comprise additional formulation ingredients selected from the group of ingredients consisting of initiators, catalysts, inhibitors, dispersants, stabilizers, rheology modifiers, impact modifiers, buffers, antioxidants, defoamers, plasticizers, pigments, flame retardants, smoke retardants, or mixtures thereof U.S. Application Nos. 20070021309, 20070066491, 20070161515, and 20070181302 are incorporated herein in their entirety by reference.

Some embodiments use one or more of piezoelectric and magnetostrictive coatings whose compositions cause them to manifest these effects very strongly. The tracking of the "tagged" proppant particles by means of a signal that is readily distinguished from the background is thus facilitated. In such embodiments, the piezoelectric coatings fall into the category of ferroelectric materials; defined in terms of being spontaneously polarizable and manifesting reversible polarization, and exemplified by piezoelectric ceramics with the perovskite crystallographic structure type such as lead zirconate titanate (PZT) and barium titanate. In other such embodiments, magnetostrictive coatings manifest "giant magnetostriction"; as exemplified by Terfenol-D (a family of alloys of terbium, iron and dysprosium), Samfenol (a family of alloys of samarium and iron, sometimes also containing other elements such as dysprosium), and Galfenol (a family of alloys of gallium and iron, sometimes also containing other elements).

Different products in some of the classes of piezoelectric or magnetostrictive materials named above manifest very different temperature dependences for the electric field or the magnetic field generated by an applied stress. One criterion in selecting piezoelectric or magnetostrictive coatings for use in the embodiments of the invention is that the temperature dependence of the electric field or the magnetic field generated by an applied stress should be as weak as possible over a downhole use temperature range of the proppant. In practice, piezoelectric or magnetostrictive materials that meet this requirement generally have (a) a Curie temperature ($T_c$) that is significantly above the maximum temperature that a proppant is expected to encounter during use, and (b) no pronounced secondary structural relaxations occurring between the minimum and maximum temperatures that a proppant is expected to encounter during use. When a piezoelectric or magnetostrictive coating material satisfies these criteria, the generated electric field or magnetic field can often be related in a relatively simple manner to the location and amount of the proppant particles and to the closure stress without needing to deconvolute the effects of the temperature dependence.

In some embodiments, the methods for applying a coating whose electromagnetic properties change under a mechanical stress to a particulate substrate are the adhesion of powders of a coating material to said substrate by using a thermosetting or a thermoplastic adhesive.

The "untagged" proppants (particulate substrates not coated yet by a piezoelectric or magnetostrictive material) that are coated to obtain some embodiments of the invention have a true density in the range of 1.00 to 1.11 g/cm$^3$. (For simplicity, in all further discussion, the term "density" will be used to represent the "true density".) Since this range is far lower than the densities of strongly piezoelectric materials such as PZT and giant magnetostrictive materials such as Terfenol-D, the density increases as the volume fraction of a composite proppant of the invention that is occupied by a piezoelectric or magnetostrictive coating is increased.

In some embodiments, the amount of a piezoelectric or magnetostrictive coating ranges from 0.01% by volume of a coated composite proppant up to a maximum value chosen such that a composite proppant comprising said coating has a density in the range that is commonly considered to be "lightweight" by workers in the field of the invention (not exceeding 1.75 g/cm$^3$). In other embodiments, the amount of said coating ranges from 0.1% by volume of the coated composite proppant up to a maximum value that is chosen such that said composite proppant has a density in the range that is commonly considered to be "ultralightweight" by said workers (not exceeding 1.25 g/cm$^3$).

The maximum volume fraction of a piezoelectric or magnetostrictive coating for which the density of a coated proppant remains within the limits of no greater than 1.75 g/cm$^3$; or no greater than 1.25 g/cm$^3$, depends strongly on the density of the coating material. Consequently, an important general principle in the design of the embodiments is that, when comparing candidate piezoelectric or magnetostrictive coating materials that possess responses of comparable strength (and hence of comparable detectability), it is generally desirable to select the material of lowest density.

As a non-limiting illustrative example, consider FracBlack™ (density of roughly 1.054 g/cm$^3$) thermoset nanocomposite beads of the Sun Drilling Products Corporation as modified by a coating of Terfenol-D (density of roughly 9.2 g/cm$^3$). The density of an embodiment of the invention where Terfenol-D is coated on FracBlack™ beads will reach 1.25 g/cm$^3$ at a Terfenol-D content of approximately 2.4% by volume (approximately 17.7% by weight) and 1.75 g/cm$^3$ at a Terfenol-D content of approximately 8.5% by volume (approximately 44.8% by weight).

A strongly piezoelectric or giant magnetostrictive coating material is often significantly more expensive per unit weight than the proppant which it will coat. It should, therefore, be obvious that the use of as little of the coating material as possible to obtain an unambiguously detectable response often has an economic advantage in addition to a technical advantage.

More generally, the density, D, of an embodiment of the invention can be estimated via a linear relationship in terms of the volume fractions and densities of the components. If the volume fraction of the particulate substrate in a coated proppant of the invention is denoted by $V_u$, then the volume fraction of the piezoelectric or magnetostrictive coating equals $V_c=(1-V_u)$. The relationship is $D=D_1\times V_u+D_2\times(1-V_u)$ where $D_1$ is the density of the unmodified material and $D_2$ is the density of the piezoelectric or magnetostrictive coating. In the specific example given above, the calculations were carried out by using this equation with $D_1$=1.054 g/cm$^3$, $D_2$=9.2 g/cm$^3$, and D=1.25 g/cm$^3$ or D=1.75 g/cm$^3$, and solving for the value of $V_u$, finally to obtain the volume percentage of Terfenol-D as $100\times(1-V_u)$.

The thickness of a piezoelectric or magnetostrictive coating that increases the density of a composite proppant of the invention to the upper limit of 1.75 g/cm$^3$ for some embodiments or to the upper limit of 1.25 g/cm$^3$ for other embodiments increases with the diameter of the uncoated proppant (particulate substrate). More specifically, the diameter of a spherical bead that has a diameter of d before being coated increases to (d+2t) after a coating of thickness t is placed on it. Since the volume of a sphere is proportional to the cube of its diameter, the volume fraction $V_c$ of the coating equals $[(d+2t)^3-d^3]/(d+2t)^3=1-[d/(d+2t)]3$. For example, with FracBlack™ beads (density of roughly 1.054 g/cm$^3$) as the particulate substrate and Terfenol-D (density of roughly 9.2 g/cm$^3$) as the coating material, a coating volume fraction of $V_c$=0.024 (2.4% coating by volume), and hence a density of approximately 1.25 g/cm$^3$, will be reached with coating thicknesses of roughly t=5.75 microns on a bead of d=1.41 millimeters (U.S. mesh size 14) but t=1.71 microns on a bead of d=0.42 millimeters (U.S. mesh size 40).

What is claimed is:

1. A method for tracking and monitoring proppants in a downhole environment, comprising the steps of:

providing composite proppants, said composite proppants comprising a particulate substrate having an external surface, and from approximately 0.001% to approximately 75% by volume of a material having electromagnetic properties which change under a mechanical stress;

emplacing said proppants in a fracture in said downhole environment, whereupon they become subjected to the closure stress of said fracture, resulting in changes of electromagnetic properties of said composite proppants; and measuring changes in said electromagnetic properties of the composite proppants to track and monitor the locations of said composite proppants.

2. The method of claim 1, where said composite proppant comprises said material having electromagnetic properties which change under a mechanical stress as a coating on the external surface of said particulate substrate.

3. The method of claim 2, where said coating is applied to said particulate substrate by a method comprising adhesion of powders of a coating material to said substrate by using a thermosetting adhesive, adhesion of powders of a coating material to said substrate by using a thermoplastic adhesive, a sol-gel process, electrophoretic deposition, fluidized bed coating, spray-coating, or combinations thereof.

4. The method of claim 2, where said coating may consist of any suitable number of layers.

5. The method of claim 2, where said change of electromagnetic properties of the coating under a mechanical stress comprises a piezoelectric effect, a magnetostrictive effect, or combinations thereof.

6. The method of claim 5, where said coating is a ferroelectric material.

7. The method of claim 6, where said ferroelectric material is selected from the group consisting of lead zirconate titanate (PZT), barium titanate, or mixtures thereof.

8. The method of claim 5, where said coating is a giant magnetostrictive material.

9. The method of claim 8, where said giant magnetostrictive material is selected from the group consisting of Terfenol-D, Samfenol, Galfenol, or mixtures thereof.

10. The method of claim 5, where said coating (a) possesses a Curie temperature that is above a maximum temperature expected to be encountered in a downhole environment during use, and (b) lacks pronounced secondary structural relaxations between a minimum temperature and a maximum temperature expected to be encountered in a downhole environment during use.

11. The method of claim 5, where said coating is present on said composite proppant at from approximately 0.01% by volume up to a maximum volume percentage chosen such that the true density of said composite proppant does not exceed approximately 1.75 g/cm$^3$.

12. The method of claim 5, where said coating is present on said composite proppant at from approximately 0.1% by volume up to a maximum volume percentage chosen such that the true density of said composite proppant does not exceed approximately 1.25 g/cm$^3$.

13. The method of claim 1, where said particulate substrate is selected from the group consisting of sands, ceramics, polymers, agglomerates held together by means of a binder material, or mixtures thereof.

14. The method of claim 1, where said particulate substrate comprises a thermoset polymer.

15. The method of claim 14, where said particulate substrate is manufactured via a suspension polymerizing process.

16. The method of claim 15, further comprising subjecting said particulate substrate to heat treatment as a post-polymerizing process.

17. The method of claim 14, where said particulate substrate is substantially spherical in shape; where a substantially spherical particle is defined as a particle having a roundness of at least 0.7 and a sphericity of at least 0.7, as measured by the use of a Krumbien/Sloss chart.

18. The method of claim 14, where said thermoset polymer comprises a terpolymer of styrene, ethylvinylbenzene, and divinylbenzene.

19. The method of claim 18, where one or more of the styrene, ethylvinylbenzene and divinylbenzene molecules used in the reactive precursor mixture are replaced by reactive ingredients originating from renewable resources selected from the group consisting of vegetable oils, animal fats, or mixtures thereof.

20. The method of claim 14, where nanofiller particles possessing a length that is less than 500 nanometers in at least one principal axis direction are dispersed in said thermdset polymer.

21. The method of claim 20, where said nanofiller comprises carbon black.

22. The method of claim 14, where a polymer precursor mixture used in manufacturing said particulate substrate further comprises additional formulation ingredients selected from the group of ingredients consisting of initiators, catalysts, inhibitors, dispersants, stabilizers, rheology modifiers, impact modifiers, buffers, antioxidants, defoamers, plasticizers, pigments, flame retardants, smoke retardants, or mixtures thereof.

23. The method of claim 14, where said particulate substrate has a true density in the range of 1.00 to 1.11 g/cm$^3$.

24. The method of claim 1, where said composite proppant is substantially spherical in shape; where a substantially spherical particle is defined as a particle having a roundness of at least 0.7 and a sphericity of at least 0.7, as measured by the use of a Krumbien/Sloss chart.

25. The method of claim 1, where said technique to track and monitor the locations of said proppants comprises microseismic monitoring technology.

26. A method for tracking and monitoring proppants in a downhole environment, comprising:

providing a blend of proppants, comprising at least 1% by weight of composite proppants comprising (a) a particulate substrate having an external surface and (b) from approximately 0.001% to approximately 75% by volume of a material having electromagnetic properties which change under a mechanical stress;

emplacing said blend of proppants in a fracture in said downhole environment, whereupon said composite proppants become subjected to the closure stress of said fracture, resulting in changes of electromagnetic properties of said composite proppants; and measuring changes in said electromagnetic properties by means of any suitable technique to track and monitor the locations of said proppants.

27. A composite proppant composition, comprising:

a thermoset particulate substrate, comprising a terpolymer of styrene, ethylvinylbenzene, and divinylbenzene; and from approximately 0.001% to approximately 75% by volume of a coating material placed on said thermoset particulate substrate, where said coating material is selected from the group consisting of lead zirconate titanate (PZT), barium titanate, Terfenol-D, Samfenol, Galfenol, or mixtures thereof.

28. The composite proppant composition of claim 27, further comprising nanofiller particles, possessing a length that is less than 500 nanometers in at least one principal axis direction, dispersed in said thermoset particulate substrate.

29. The composite proppant composition of claim 28, where said nanofiller comprises carbon black.

30. The composite proppant composition of claim 27, where a polymer precursor mixture used in manufacturing said thermoset particulate substrate further comprises additional formulation ingredients selected from the group of ingredients consisting of initiators, catalysts, inhibitors, dispersants, stabilizers, rheology modifiers, impact modifiers, buffers, antioxidants, defoamers, plasticizers, pigments, flame retardants, smoke retardants, or mixtures thereof.

31. The composite proppant composition of claim 27, manufactured via a suspension polymerizing process, and optionally subjected to heat treatment as a post-polymerizing process.

32. A blend of proppants, comprising at least 1% by weight of the composite proppant of claim 27.

* * * * *